US010443624B2

(12) United States Patent
Hustvedt

(10) Patent No.: US 10,443,624 B2
(45) Date of Patent: Oct. 15, 2019

(54) MODULAR FAN UNIT APPARATUS AND METHODS

(71) Applicant: AcoustiFLO, LLC, Boulder, CO (US)

(72) Inventor: David Hustvedt, Boulder, CO (US)

(73) Assignee: Acoustiflo, LLC, Boulder, CO (US)

( * ) Notice: Subject to any disclaimer, the term of this patent is extended or adjusted under 35 U.S.C. 154(b) by 0 days.

(21) Appl. No.: 15/820,140

(22) Filed: Nov. 21, 2017

(65) Prior Publication Data

US 2018/0283401 A1 Oct. 4, 2018

Related U.S. Application Data

(60) Provisional application No. 62/601,671, filed on Mar. 28, 2017.

(51) Int. Cl.
*F04D 29/62* (2006.01)
*F04D 29/44* (2006.01)
(Continued)

(52) U.S. Cl.
CPC ..... *F04D 29/624* (2013.01); *F04D 25/08* (2013.01); *F04D 29/4253* (2013.01);
(Continued)

(58) Field of Classification Search
CPC .. F04D 29/624; F04D 29/4253; F04D 29/464; F04D 29/444; F04D 29/661; F04D 25/08; F04D 17/165; F04D 17/164
See application file for complete search history.

(56) References Cited

U.S. PATENT DOCUMENTS 3,425,621 A * 2/1969 Greenheck ..... F04D 17/165 415/201
3,650,633 A * 3/1972 Benoit ..... F04D 17/025 415/143
(Continued)

FOREIGN PATENT DOCUMENTS

DE 202017101353 U1 * 5/2017 ..... F04D 29/444

OTHER PUBLICATIONS

Kees, Inc, Kees Air Handling Unit Fan Selection Guide, Dec. 13, 2016, https://web.archives.org/web/2016123035020/http://www.kees.com/pdf/fsg.pdf.*
(Continued)

*Primary Examiner* — David E Sosnowski
*Assistant Examiner* — Brian P Wolcott
(74) *Attorney, Agent, or Firm* — Santangelo Law Offices, P.C.

(57) ABSTRACT

Particular embodiments of the inventive technology present a method for optimizing fan performance by, e.g., adjusting fan efficiency and/or acoustics to match, or more closely match, system design requirements or preferences. Embodiments may involve the selection of a size of centrifugal fan 18 from the plurality that can fit inside a certain housing, forming a fan unit that provides an annular output 19; such selection may be made to achieve certain performance goals. Add-on appurtenances such as one or more of, e.g., an annular housing extension 10, fixed vanes 12, and acoustic treatment 8, may be used to tailor the fan unit to meet system requirements, e.g., regarding efficiency, acoustic/sonic performance (e.g., noise generated by the fan), and/or static efficiency.

22 Claims, 12 Drawing Sheets

(51) Int. Cl.

| | |
|---|---|
| ***F04D 25/08*** | (2006.01) |
| ***F04D 29/66*** | (2006.01) |
| ***F04D 29/46*** | (2006.01) |
| ***F04D 29/42*** | (2006.01) |

(52) U.S. Cl.
CPC ..... *F04D 29/444* (2013.01); *F04D 29/464* (2013.01); *F04D 29/661* (2013.01)

(56) References Cited

U.S. PATENT DOCUMENTS

| | | | | |
|---|---|---|---|---|
| 4,411,453 | A * | 10/1983 | Philipps | F04D 29/4213 285/18 |
| 4,859,140 | A * | 8/1989 | Passadore | F04D 29/464 415/48 |
| 7,001,140 | B2 | 2/2006 | Hustvedt et al. | |
| 7,357,621 | B2 | 4/2008 | Hustvedt et al. | |
| 8,100,637 | B2 * | 1/2012 | Sinzaki | F04D 29/281 415/119 |
| 8,272,700 | B2 | 9/2012 | Suzuki et al. | |
| 2014/0038509 | A1 * | 2/2014 | Madorell Costa | F24F 13/24 454/251 |
| 2016/0319843 | A1 | 11/2016 | Tracy | |

OTHER PUBLICATIONS

U.S. Appl. No. 62/601,671, filed Mar. 28, 2017. First Named Inventor: Hustvedt.

* cited by examiner

MODULAR FAN UNIT APPARATUS AND METHODS

This US Non-Provisional patent application claims priority to and the benefit of U.S. Provisional Application No. 62/601,671, filed Mar. 28, 2017, said provisional patent application incorporated herein by reference thereto, in its entirety.

BACKGROUND OF THE PRESENT INVENTION

The present disclosure is, in particular embodiments, directed to methods and apparatus relating to an adapted fan unit (e.g., fan module with fan, housing, motor, supports, possibly appurtenances) that exhibits improved, perhaps even optimal aerodynamic and/or acoustic performance. Such fan units are normally employed in building ventilation systems.

Air delivery systems for building ventilation may include one or more centrifugal fan units. Such fan units typically are intended to meet specified performance criteria, such as flow, output pressure, input power, and acoustic output. Current practice is to use fans that meet the basic criteria of flow and pressure, but with a compromise of efficiency (whether static or total efficiency) and/or acoustic performance. In many applications, there may be a need for maximum efficiency, but with relaxed acoustic requirements. Conversely, some applications may require minimum noise at the expense of efficiency. At times, this may be due to a desire to use the same size housing for different units that are in fluidic communication (e.g., a supply fan and a return fan, which together, or either alone, is a type of air handling apparatus).

With current fan technology, in particular applications it is not possible to selectively optimize a fan for efficiency or acoustic performance. Typically, mitigation of noise requires the installation of sound traps external to the fan—with a resulting increase in overall air handler length and cost, and a decrease in efficiency. Furthermore, fans are most efficient over a relatively narrow range of the flow-pressure curve, and design flow-pressure conditions may require that a fan be selected outside the region of peak efficiency.

Previous U.S. Pat. Nos. (7,001,140 and 7,357,621) describe methods for increasing the static efficiency of centrifugal fans through proper design of fan housings. Other patents describe installing centrifugal fans in modular acoustically insulated housings to allow installation of arrays of fans in building ventilation applications (e.g. U.S. Pat. No. 8,272,700.) U.S. Pat. No. 7,001,140 is also prior art. Particular embodiments of the inventive technology may leverage that disclosure to allow a variety of fan wheel diameters and linings in an efficient axial discharge housing. That patent's FIG. 15 shows one way of generating an annular output; such housing may be used in particular embodiments of the inventive technology disclosed herein. Note, however, that the momentum diffuser shown in that figure, while certainly usable in such embodiments, is not a required feature thereof.

Prior art centrifugal fans for building ventilation are shown in FIG. 1. Current practice includes unhoused centrifugal 1 or housed fans 2 intended to be installed in arrays of fans. FIGS. 1A and 1B of the instant disclosure are prior art. FIG. 1A shows a standard plenum fan an unhoused centrifugal fan). FIG. 1B shows a centrifugal fan in a box housing; it has no internal flow path and affords no way in which to add vanes 12 or efficiency enhancing acoustic treatment (e.g., lining, treatment). None of the existent prior art describes the tailoring of a fan module or fan unit (which include the outer housing housing) appurtenances to particular efficiency, aerodynamic performance, and/or acoustic performance requirements; in this sense, the invention may involve modular air handling systems.

As relevant background in one application, air handlers (the units that typically provide ventilation air in buildings) typically have two sets of fans that are in fluidic communication—one is the higher pressure fan array (supply fans) that pushes air into the building and the other is a lower pressure fan array (return fans) that pulls air back out of the building. Typically, the supply and return fans need to handle approximately the same volume flow of air, and the static pressure requirements for the return fans is less than that of the supply fans. Fans of a single fan wheel diameter (size) cannot serve as both supply and return fans in a way that maximizes efficiency for the system (or for each fan); indeed, in may applications, a single fan diameter cannot even serve both applications in an efficient manner whatsoever. Certain embodiments of the inventive technology disclosed herein may achieve substantially the same efficiency for each of the fan units that are in fluidic communication by tailoring one or more of such fan units, via, e.g., selection of non-traditionally used wheel sizes, use of acoustic treatment 8, and/or use of fixed vanes 12. Particular embodiments of the inventive technology disclosed herein may allow for optimization of one or more system parameters (e.g., static efficiency and acoustic performance) of fans that are in fluidic communication.

SUMMARY OF THE PRESENT DISCLOSURE

The present invention, in its various embodiments, provides, inter alia, a method for optimizing fan performance by, e.g., adjusting fan efficiency and/or acoustics to match, or more closely match, system design requirements or preferences. Embodiments may involve the selection of a size of centrifugal fan 18 from the plurality that can fit inside a certain housing, forming a fan unit; such selection may be made to achieve certain performance goals. For example, a smaller fan (and its smaller motor) in a particular housing may allow space for acoustic treatment 8; selection of a smaller fan may thus enable the achievement of reduced fan noise. And fixed vanes 12 can be used with any fan wheel diameter size; they may may allow for an increase of static efficiency as intended. Typically, the inventive technology finds application to fan units 15 with housing(s) that discharge an annular output 19. Certain embodiments relate to the tailoring of the fan unit to system requirements, e.g., regarding efficiency, acoustic/sonic performance (e.g., noise generated by the fan), and/or static efficiency, by, for example, an array of add-on appurtenances at, e.g., the outlet. Note that typically a centrifugal fan is used (with an appropriately shaped housing) to generate an annular output, but it is possible to use an axial fan (with an appropriately shaped housing) to yield an annular discharge. Accordingly, particular aspects of the inventive technology may include centrifugal fans or axial fans.

The ability to select, from a plurality of different diameter wheels that can fit in the same size housing, a fan of a particular size provides several advantages. An appropriately selected wheel size may allow for the use of fixed vanes 12 and/or acoustic treatment 8 to achieve improvements in efficiency and/or acoustic performance (e.g., a reduction in fan generated noise).

One significant possible advantage in certain embodiments may be the increase in, perhaps even maximization of, the efficiency of an air moving system. Generally, the advantages include but are not limited to: uniform installation design in the air handler; reduction in manufacturing complexity by needing to build fewer housing configurations; allowance, in certain applications, of the installation of insulation to attenuate outlet noise with smaller fans (which tend to be at higher speeds and noisier than bigger fans); allowance, in certain applications, of the installation of fixed vanes 12 in order to convert at least some swirl velocity to static pressure; and/or allowance of tailoring of acoustics and efficiency for project specific requirements.

A housing that is sized to accommodate various sizes of centrifugal fan 18 can bring with it several benefits. For example, such a housing can allow for installation of the housing, allowing for a later option to insert, perhaps in situ, a fan of a selected size from the various sizes in order to tailor the fan unit 15 to meet certain system goals (e.g., increased efficiency and/or sound mitigation) while also meeting flow and static pressure requirements. The ability, after installation of a fan housing 3, to thereafter fine tune a fan unit for a certain application by installing a non-traditional size fan wheel in that housing (e.g., thereby increasing efficiency and/or sound attenuation) may also be a benefit of the inventive technology. At times, in-situ, operational testing may even allow for change of a fan from one size to another without needing to change the housing. Such a housing may also allow for reduced equipment and/or labor costs due to the use of housings of identical size for several or even all fans in an application (e.g., all supply fans and all return fans may be of the same size), and the possible reduction in the need for enlargement and/or contraction ductwork in some applications.

An example can help to illustrate a beneficial advantage provided by particular aspects of the inventive technology: a supply fan to provide 12000 cubic feet per minute (cfm) at 4 inches of static pressure is fairly typical; such requirements can be met with a 27 inch diameter (fan wheel size) fan operating at 1500 rpm with an efficiency of 73%. A return fan in this exemplary system needs to move 12000 cfm at (typically) 2 inches of static pressure. If one were to use more of the 27 inch fans as return fans at 12000 cfm and 2 inches pressure, their efficiency would only be 65% (at 1278 rpm). On the other hand, if one were to use a 30 inch fan it could provide the 12000 cfm at 2 in with an efficiency of 71% at 1020 rpm. In addition to being efficient, the 30 inch fan would be about 5 dB quieter than the 27 inch fan.

Additional advantages, as mentioned, may relate to the use of fixed vanes 12 to convert swirl velocity (of a centrifugal fan output), thereby increasing static pressure, and static efficiency. Such vanes may be used with or without acoustic treatment 8, such as acoustic lining, to mitigate sound and improve acoustic performance. Of course, additional advantages may be as disclosed elsewhere herein.

BRIEF DESCRIPTION OF THE DRAWINGS

The accompanying drawings, which are provide a further understanding of the present disclosure, are incorporated in and constitute a part of this specification, illustrate aspects of the present disclosure and together with the detail description serve to explain the principle of the present disclosure. No attempt is made to show structural details of the present disclosure in more detail than may be necessary for a fundamental understanding of the present disclosure and the various ways in which it may be practiced. In the drawings.

DESCRIPTION OF THE PREFERRED EMBODIMENTS

Figure 1A:
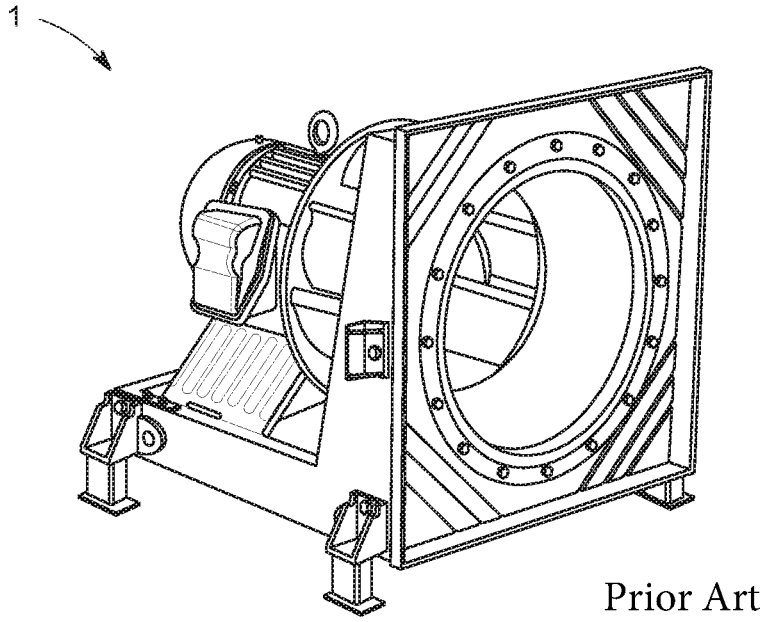
FIGS. 1A and 1B show prior art centrifugal fans for building ventilation.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments are not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

In certain of the various embodiments, the concept as presented is that a given size housing (e.g., diameter) that is selected for a certain application could accommodate several, e.g., three, four or more, different wheel diameters. Typically, each fan unit 15, and each housing would have one fan in it (fans may be arranged in an array(s)), although more than one fan stacked in-line in a single housing is a possible embodiment). As but one example, and considering only commercially available fan sizes, one could fit into a 54" outer housing, fan wheels 4 of the following sizes: 30", 27", and 24.5" diameter. The housing can have installed therein one of several different sized fans that could fit into the housing, in order to better match system requirements or performance goals and/or allow the use of appurtenances to achieve them. Certain embodiments involve the addition/installation of one or more appurtenances to become part of such fan unit allowed for by the selected size fan. Note that the depth (the length of the airfoil in the axial direction) may vary with the diameter of the fan wheel 17; the number of blades may or may not vary. Depending on the magnitude of the variation one could fit any number of fan wheels into a given housing, although typically only one is used.

Often, when the largest diameter wheel 17 (with fan blades) that can fit into the housing (or perhaps even the largest ⅓ (or other portion, as discussed elsewhere herein) of all different fan sizes that can fit into the housing) is installed (e.g., in low pressure/high flow return fan applications), no acoustic treatment 8 would be used. Middle sized wheels (e.g., the middle ⅓ of all different fan sizes that can fit into the housing) would have less flow capacity but would allow the installation of some acoustic treatment 8 on the outlet to reduce outlet noise. In certain possible configurations, a housing extension 10 at fan outlet may be used with acoustic treatment and with or without vanes 12 (to recover static pressure and increase static efficiency). Vanes convert velocity pressure to static pressure but at the expense of total efficiency (but typically in the case of building ventilation systems, maximizing static pressure is the goal). Like any housing, the annular housing and/or any housing extension 10 may be acoustically treated. An inner housing 5 surrounding the motor 6 may also (or instead) be acoustically treated (note that the motor, while shown in the figures as being at least partially enclosed by the fan housing, may instead be located outside of the fan housing (e.g., in the case of a belt driven centrifugal fan, where the axis of rotation of the motor, while perhaps parallel with the axis of rotation of the fan, is different from it).

Where the smallest ⅓ (or other portion, as discussed elsewhere herein) of the possible fan sizes were used, such would reduce flow capacity (to, e.g., perhaps 80%, or even 75% of that provided with the largest size fan wheel 17) but would allow more acoustic treatment 8 and hence a much quieter fan. Use of a fan wheel 4 that is of the smallest ⅓ possible wheel sizes that can fit in the housing could allow for the installation of vanes 12 and/or other appurtenances at, e.g., the outlet, whether within a housing extension 10 or not. Indeed, the inventive technology, in particular embodiments, may be described as selectively installing a fan having a fan wheel size (diameter) that is one of several possible sizes that will fit into a particular housing (that yields an axial discharge) to form a fan unit, and within a certain subset of the smaller or larger of such fans, and adding or perhaps even removing acoustic treatment to adjust acoustic performance as desired, with (or without) vanes to adjust static pressure as desired.

Particular embodiments of the modular technology disclosed herein allow for the tailoring of the system via one or more of the selection of fan wheel size, the selection of housing size, and the use (or non-use) of appurtenances such as fixed vanes 12 and/or acoustic treatment 8 to adjust efficiency and/or acoustic performance. Use of existing technologies may provide a fan unit 15 with a greater than required acoustic reduction at the expense of efficiency in certain embodiments, the use of an appropriately selected fan size and vanes 12 may provide a desired efficiency (e.g., via an increase in efficiency) while allowing for an allowable increase in noise. Note also that certain embodiments of the inventive technology may also relate to the improvement of both acoustic performance and static efficiency via the selection of a fan size that allows for the use of acoustic treatment 8 and fixed vanes 12, and the use of such fans as part of such fan unit.

Certain method embodiments of the inventive technology may be described generally as: selecting a fan housing 3 of a certain housing diameter (housing size), the fan housing having an annular interior 16 (an annular housing 3) and capable of housing several different fan wheel sizes; and selecting, from a largest one-third or a smallest one-third (or other fraction, such as one-quarter or one-fifth) of the several different fan wheel sizes that can be housed in the fan housing 3 of the certain housing diameter, one of the different fan wheel sizes in order to meet at least one air handling performance goal. The fan has a fan axis of rotation 21; the air handling performance goal may be: efficiency goal (e.g., increase in efficiency); sound goal (e.g., mitigation/reduction of noise from fan); static pressure goal (e.g., increase in static pressure produced by fan); an engine speed goal (e.g., decrease in required engine speed); an engine horsepower goal (e.g., decrease in required engine horsepower); engine size goal (e.g., decrease in required engine size); an energy consumption goal (e.g., decrease in energy consumption by fan); and operating cost goal (e.g., decrease in operating cost); and any combination of the preceding. Such a goal may be identified when, e.g., an operator or user recognizes that it may be beneficial to, e.g., improve efficiency, reduce fan noise, reduce energy consumption; steps may then be taken to implement aspects of the inventive technology to achieve that goal As mentioned, particular embodiments of the inventive technology disclosed herein may involve selecting, from a largest one-third or a smallest one-third (or other ratio such as one-quarter) of the several different fan wheel sizes that can be housed in the fan housing 3 of the certain housing diameter, one of the different fan wheel sizes in order to meet the at least one air handling performance goal, the fan having a fan axis of rotation 21. Note that other embodiments, all part of the inventive technology, may involve a similar such selection, but instead from the largest or smallest ¼ or even ⅕ of the several different fan wheel sizes that can be housed in the fan housing of the certain housing diameter.

Note that the several different fan wheel sizes that can be housed in the fan housing 3 of the certain housing diameter may be commercially available wheels (e.g., that come in 3-inch diameter increments such as 30", 27", 24"), although such limitation is not a requirement at all. Other fan manufacturers have different increments (e.g., 2"). With 3 in, diameter increments one may conceivably put one of three different wheels (e.g., 30", 27", 24") in a given housing. With 2-inch diameter increments one may conceivably put one of four wheels (e.g., 29", 27", 25", 23") in a given housing. Note that it may be that different increments (including but not limited to 1", ½", ¼", etc.)—whether of commercially available fans or not—may be applicable.

Use of larger fans, which may have larger flow capacities, would often benefit from some modification of the flowpath to optimize performance. Such modification may come in the form of downstream components such as sound attenuation, an outwardly divergent diffuser 22 and/or swirl reducing vanes 12 although at times space limitations imposed by the larger size fans may preclude their use (but one option in response may be to use a housing extension 10). An extension, and the housing that it is a part of, may be configured to produce an annular output 19; the various figures of the instant disclosure, in addition to known technologies such as that shown in FIG. 15 of U.S. Pat. No. 7,001,140, are examples of what a housing so configured may look like. The exterior of such housing may be any convenient shape (perhaps as dictated by the application). The size of vanes 12, and their ability to increase static pressure and increase efficiency, may depend on the size of the fan with respect to the particular housing. Note also that in certain applications there may be a goal to allow a tradeoff between airflow volume (cfm) and acoustics. The smaller fan wheels (for a given housing) may provide space for installation of acoustic treatment 8 but they provide less flow.

Figure 2:
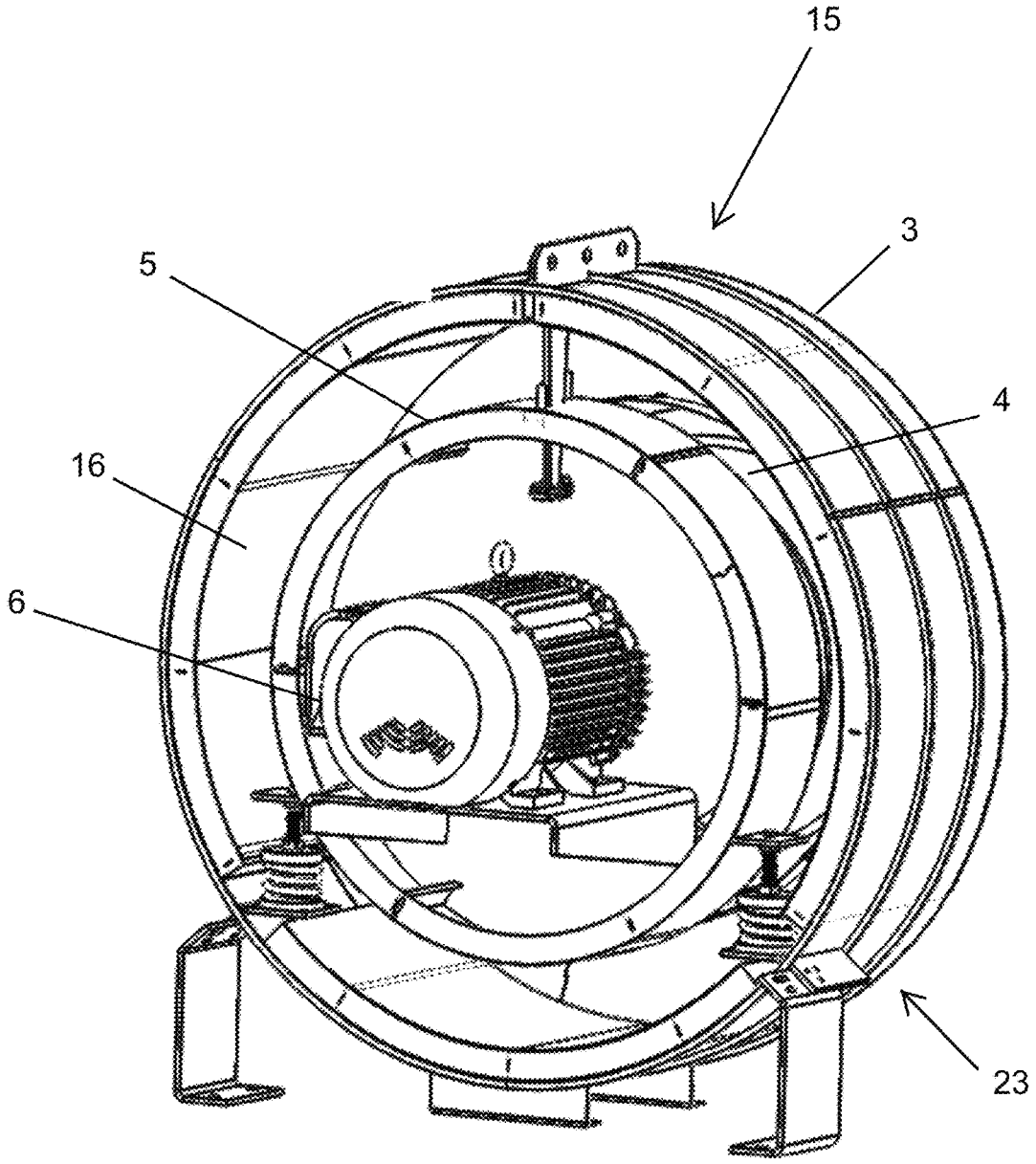
FIG. 2 shows a perspective view from the rear of an inventive fan unit as may appear in particular embodiments of the inventive technology.

The modular adaptive fan unit of FIG. 2 features a housing 3 having an annular interior 16 (i.e., a housing with an exterior of any shape and an interior shaped to direct air impelled by a fan to output along an annular flowpath 19), configured to expel an annular output 19 in a direction 20 parallel with the fan axis of rotation 21, and a fanwheel and motor. The annular interior of the housing may convert a radial output (from a centrifugal fan) into an annular output that is parallel with the axis of rotation of that fan. The annular housing defines a generally annular flow path (an associated annulus may have an outer radius and an inner radius at, e.g., the outlet of that housing, and indeed at any point along that annular flowpath within the housing). The housing (interior) is sized such that a variety of fan wheel 4 diameters may be installed. For example, a 52-inch diameter housing could have 30, 27, or 22-inch diameter fan wheels installed. In other applications, a 50" fan may be able to accommodate the following fan wheel sizes (diameters): 18", 24", 27"; a 54" fan: 24½", 27", 30"; a 60" fan: 24", 27", 31"; and a 62" fan: 29", 27", 25", 23". Note that in certain embodiments, instead of selecting a fan size in view of a fan housing size constraint, a fan size may be the constraint and the invention may relate more particularly to the selection of a fan housing size that may allow for tailoring of certain performance characteristics, e.g., via use of acoustic treatment 8 and/or fixed vanes 12.

Figure 3:
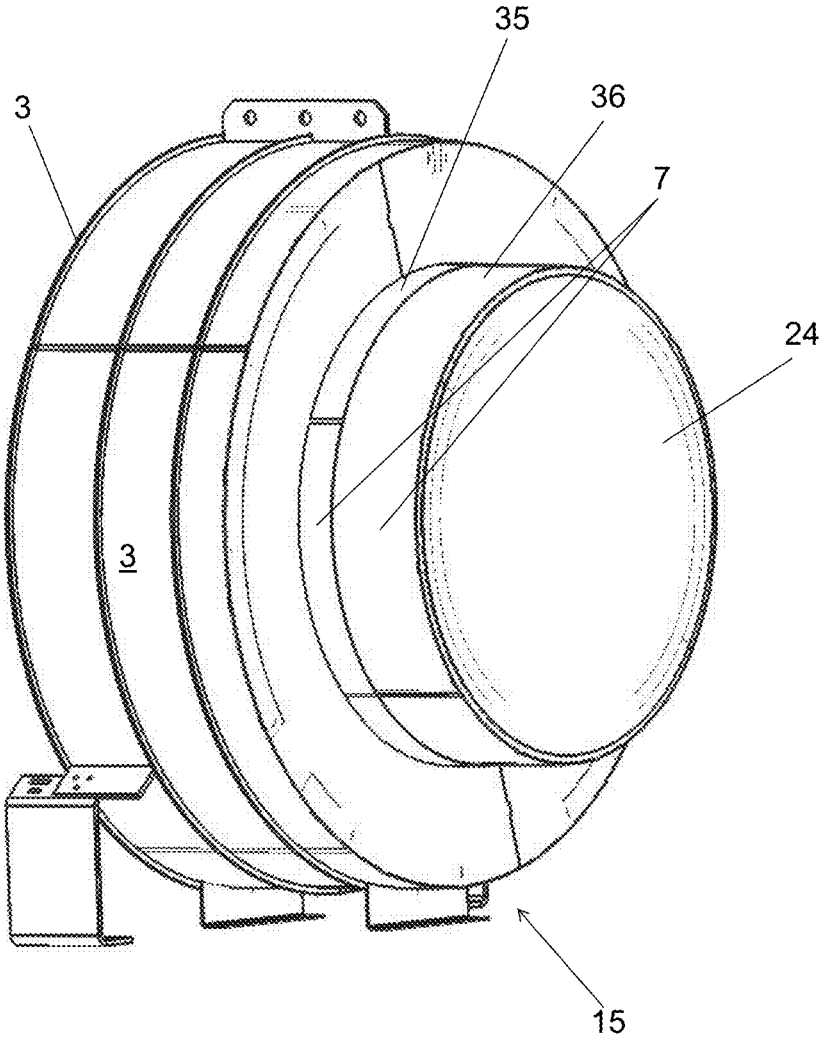
FIG. 3 shows a perspective view from the front of an inventive fan unit as may appear in particular embodiments of the inventive technology.

Inlet cones 24, perhaps as part of inlet cone units 55, for the various size fan wheels 4 can be mounted on an adjustable collar system 7, shown in FIG. 3, that allows adjustment of the position of the inlet cone relative to the housing to accommodate the variations in fan depth among the differently sized fans that can be used. Such would allow easy mating of, e.g., an inlet cone with a housed fan, where that fan has, e.g., a smaller size wheel (or more generally, any size wheel that has a different length, i.e., "depth," along the axis of rotation of the fan). For example, particular embodiments may provide a cylindrical extension that may be referred to as a sliding sleeve 36 because it can be slid inside (or possibly even outside) a fixed collar 35, e.g., a short cylindrical extension from the fan housing that is fixed with respect to the fan housing.

The sliding sleeve, in particular embodiments, forms part of an inlet cone unit and is fixed with respect to the inlet cone; it may have a slightly smaller (or possible larger) diameter than that of the fixed collar, allowing it to snugly, slidingly interface with the fixed collar to a desired extent of interface/penetration (i.e., depth adjustment). If the sliding sleeve is to slide inside the fixed collar, then its outer diameter is slightly smaller (e.g., less than 5%, less than 2%, or less than 0.5%) than the inner diameter of the fixed collar. If the sliding sleeve is to slide outside (around) the fixed collar, then its inner diameter is slightly larger (e.g., less than 5%, less than 2%, or less than 0.5%) than the outer diameter of the fixed collar. After proper interfacing of the sliding sleeve with respect to the fixed collar so that the part of the cone closest to the fan wheel is in correct position with respect to the fan wheel, the sliding sleeve (and the inlet cone and indeed the inlet cone unit) can be made immovable with respect to the fixed collar (and thus the spinning fan wheel, and the housing) via a securement element 52. Such securement element may take many forms (e.g., screws through the fixed collar and into the sliding sleeve; compression band; adhesive; biased, thumb operable button lock into selectable holes, etc.)

The extent of the interfacing (e.g., penetration) of the sliding sleeve with respect to the fixed collar may depend on the depth of the fan wheel (wheels with less depth would require greater penetration than wheels of greater depth); the goal of the interface (e.g., the penetration) between the sliding sleeve (and the cone it's a part of) and the fixed collar is typically proper positioning of the fanwheel proximate portion of the cone with respect to the fanwheel. This system allows the use of a single inlet cone unit on differently "depthed" fanwheels. Such an adjustable collar system may be necessary/helpful because smaller diameter fans are not as deep as larger wheels, so the inlet cone 24 needs to be repositioned to properly mate with the wheel.

In particular embodiments, the sliding sleeve is a cylinder with a flat annular plate (38) (with an annular opening through it, but having any outer shape) at one end through which the cone fits and is fastened to. Note that typically, the position of the fan wheel is fixed by the motor so that the clearance between the backplate 39 of the fan wheel (side of fan wheel closest to the motor) and the motor is fixed to allow interference free rotation of the fan. However the depth (the distance between the backplate of the fan wheel and the other side of the fan where the cone meets the fan) of the fan can vary. This requires the axial position of the cone to vary to properly mate with the fan. This is accomplished by sliding the sliding sleeve axially inside the fixed collar until the cone is properly positioned with respect to the fan wheel. Note that not only is a cooperatively configured fixed collar and sliding collar system a part of the inventive technology, but the inlet cone unit described herein is as well.

As mentioned, in certain embodiments, appurtenances may be installed, e.g., to help better match system performance requirements or otherwise change a fan performance parameter as desired. Accordingly, particular embodiments of the inventive technology may involve the step of installing at least one appurtenance selected from the group consisting of: an annular housing extension 10; a plurality of fixed vanes 12 (e.g., arranged in an array) established in a flowpath of the annular output; acoustic treatment 8; and any combination of the preceding.

Fixed vanes 12 may be established in a housing where possible and helpful; they may help to recover static pressure from otherwise wasted swirl velocity of the output directly from the fan. In doing so, the vanes can thereby reduce the motor power required to achieve a given outlet pressure (ideally, $P_{static,\ motor}+P_{static,\ fixed\ varies}\geq P_{static,\ required}$). Such would result in lower energy consumption and operating cost, and possibly even a reduction in motor size (hut not always because motor sizes typically "jump" by 5-10 hp).

As mentioned, vanes 12 may be added to increase static pressure achieved by a fan unit 15, thereby improving static efficiency. The vanes could conceptually be added without an extension, but vane installation in an extension may offer a degree of convenience during installation and possibly any repair. In certain applications, however, if the additional acoustic reduction possible with an insulated extension 28 is not required, then the vanes could be added inside a "base" unit (e.g., a fan unit with a fan of any size, a housing, but without appurtenances). Vanes could possibly be used with any of the fan diameters. Whether they produce a worthwhile increase in efficiency depends on how much swirl (or tangential velocity) is available. Typically the largest efficiency boost occurs when the operating point is at a high pressure/low flow point on the operating curve. Any vanes that are arranged in some sort of repeating pattern (e.g., at one or more radius(i) from a fan rotation axis 21) are said to be arranged in an array.

Note that it is known to use vanes 12 (e.g., in an array) to recover static pressure in axial fans, turbojets, etc. There are design data available for designing such vane configurations; such design data, in addition possibly to basic flow modeling and testing if required, can be used to design the particulars (e.g., size, shape, number, etc.) of a vane array for centrifugal fan units 15 with housings configured to yield an annular output 19. Their application to centrifugal fan units is novel, and inventive by itself.

Figure 10:
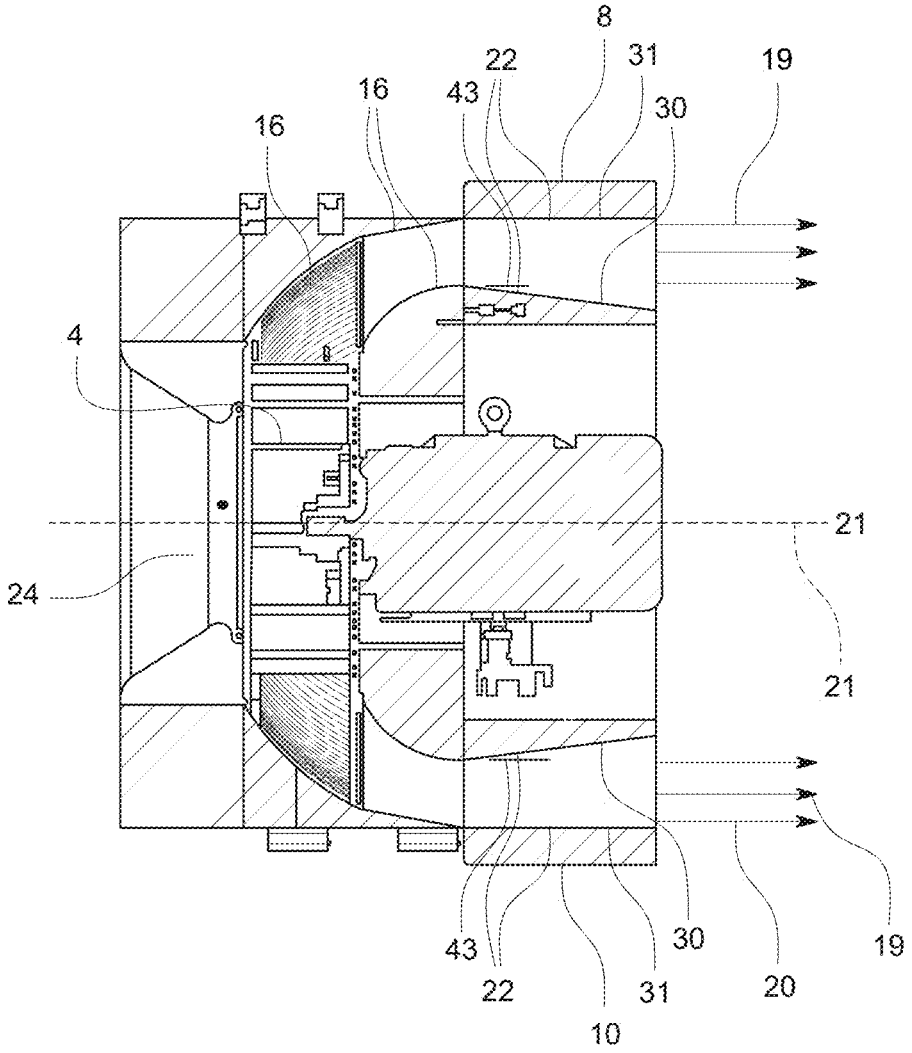
FIG. 10 shows a cross-sectional view from the right side of a fan unit, as may appear in particular embodiments of the inventive technology.
Figure 11:
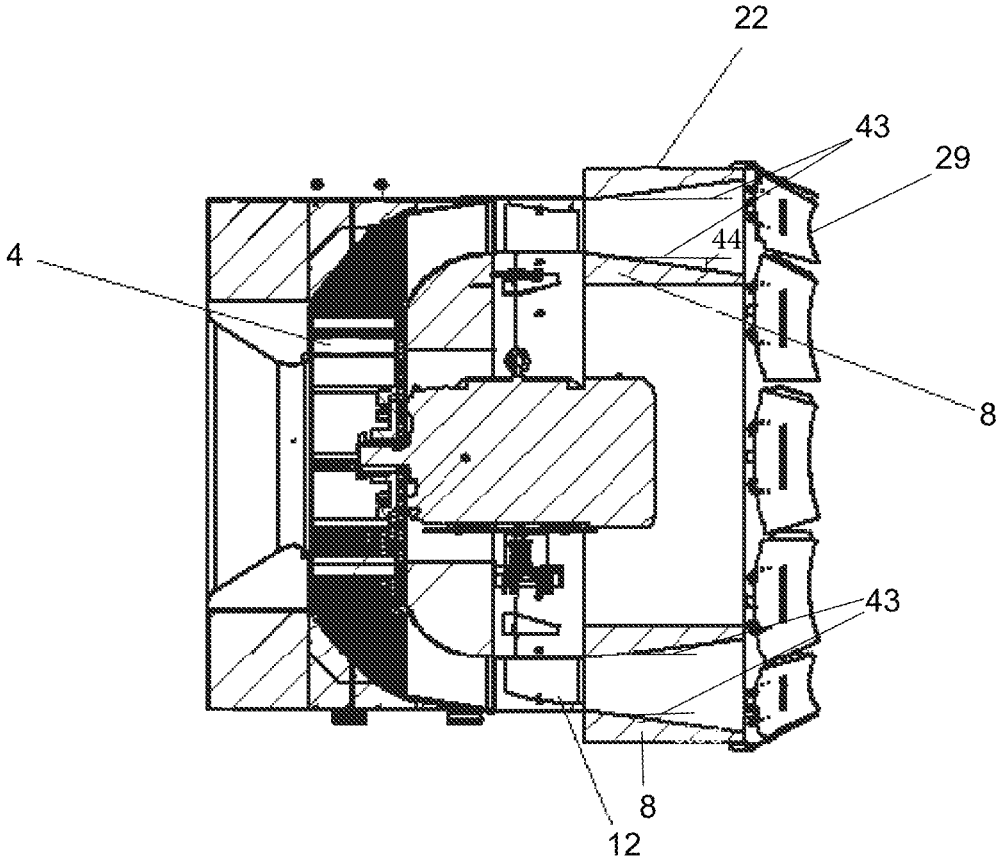
FIG. 11 shows a cross-sectional view from the right side of a fan unit, as may appear in particular embodiments of the inventive technology.
Figure 12:
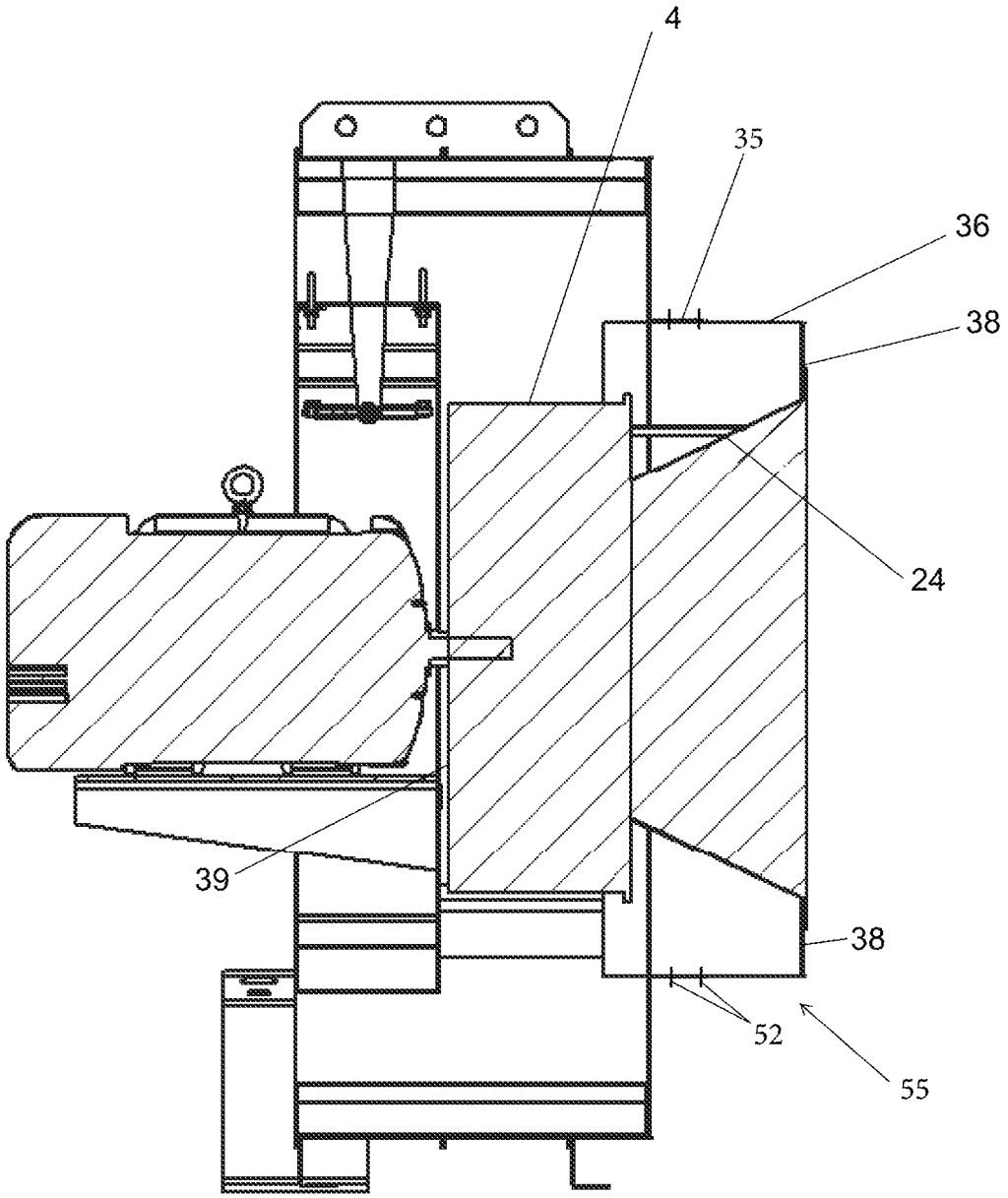
FIG. 12 shows a cross-sectional view, from the right side of a fan unit, as may appear in particular embodiments of the inventive technology. It shows an adjustable collar system, and a cone with a sliding sleeve.

An annular housing extension 10 may, inter alia, allow for noise reduction (possibly supplemental) and/or may act as a platform for installing vanes 12. The extension could be shaped as or to include an outwardly divergent diffuser 22 to recover some of the velocity energy normally lost in a plenum fan arrangement (as discussed further below); to do so, the inner part of the surface that shapes the flow could diverge towards the fan axis of rotation 21 and/or the outer part 31 of the surface that shapes the flow could diverge away from the fan axis of rotation) to enlarge a cross-sectional flow area of the annular output 19 and reduce the discharge velocity. Such a configuration could be particularly advantageous in very high flow cases. Such "axial" diffuser 22 concept per se is not new, but is when used as part of the modular centrifugal fan; an axial discharge permits one to add on such a diffuser. Such outwardly divergent diffuser may present as an annular diffuser, in particular embodiments (see, e.g., FIGS. 10 and 11).

Figure 1B:
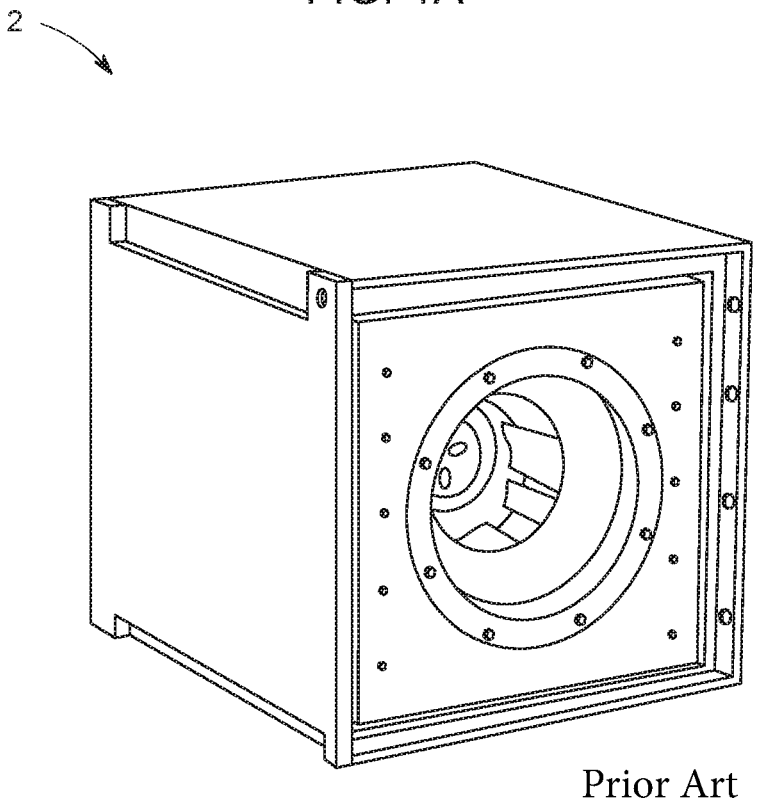

Both of the prior art fans pictured in FIG. 1 are plenum fans; they are centrifugal fans intended to be installed in a space referred to as a plenum. They are not housed in housings or directly attached to ducts, but rather discharge air into a plenum. In doing so the velocity energy is dissipated as opposed to the case where a fan expels air directly into a duct. The advantage of "plenum" fans is that they are not directly attached to a duct and therefore any number of random sized ducts can be attached to the plenum to supply air to a building. Fan units 15 in accordance with certain embodiments of the inventive technology would typically be installed in a plenum as opposed to a ducted application. The plenum could be a large space or room in a building, or a special box that is mounted somewhere in the building.

As mentioned, particular embodiments of the inventive technology may find application to systems with supply and return fans that are in fluidic communication. Often, selection of a larger diameter fan for a lower pressure application (e.g., as in a return fan) would be to increase efficiency. But such aspect of the inventive technology is not limited to such systems indeed, certain embodiments may be described as first fan unit and a second fan unit in fluidic communication, each the fan units having equally sized outer housings that each have an annular interior 16 configured to expel an annular output 19 in a direction 20 parallel with their respective fan axis of rotation 21; and a first fan within the first fan unit and a second fan within the second fan unit, the fans having a fan wheels 4 of two different diameters. The equally sized outer housings may each be capable of housing centrifugal fans of several different fan wheel sizes, and at least one of the fans has a fan wheel diameter that is from either a largest one-third of the several different fan wheel sizes that can be housed in the fan housing 3 or a smallest one-third of the several different fan wheel sizes that can be housed in the fan housing. However, in certain embodiments and applications, different size housings of fans units that are in fluidic communication may be used, perhaps even with different size fans. Regardless, one or both of the fans may have a fan wheel diameter that is from either a largest one-third of the several different fan wheel sizes that can be housed in the fan housing or a smallest one-third of the several different fan wheel sizes that can be housed in the fan housing.

Figure 4:
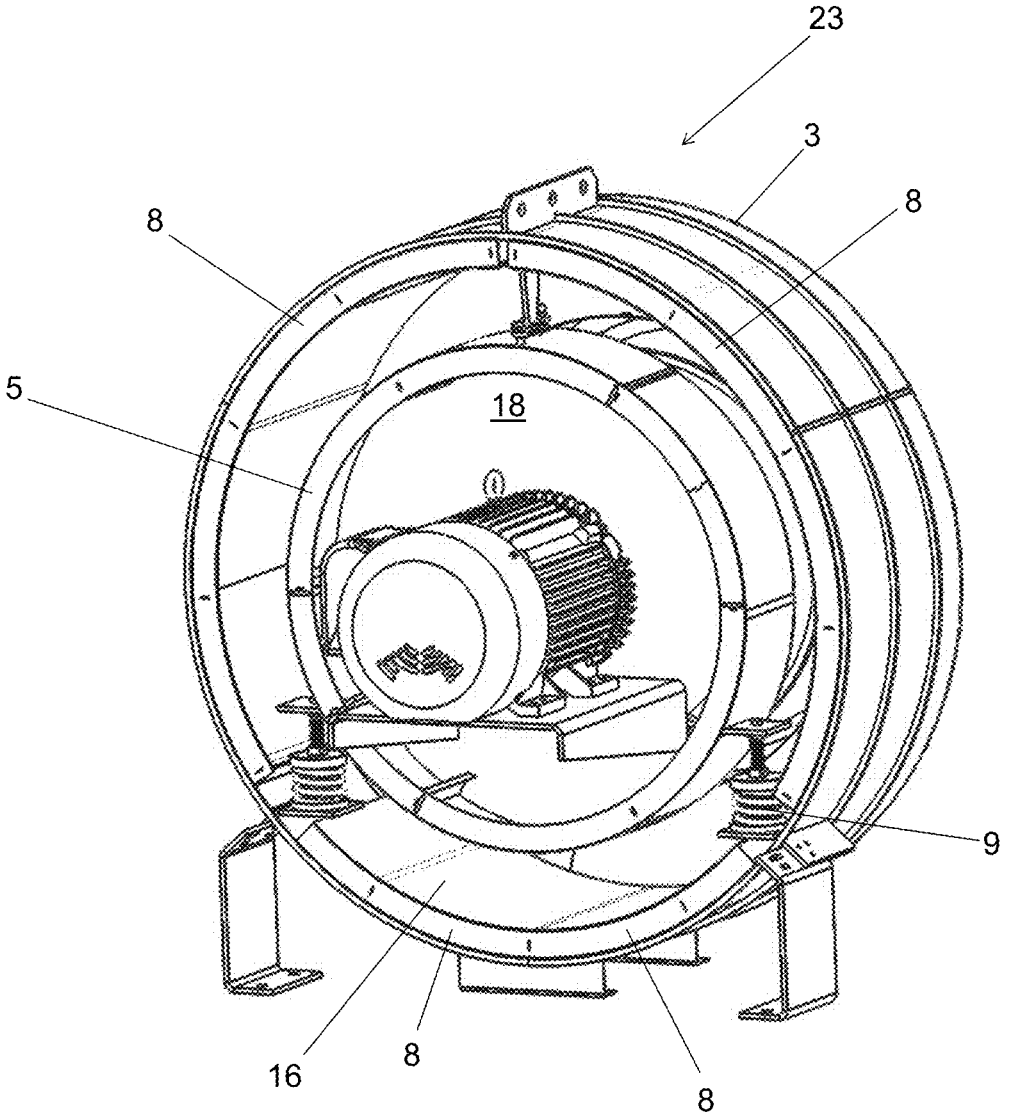
FIG. 4 shows a perspective view from the rear of an inventive fan unit with acoustic treatment 8 as may appear in particular embodiments of the inventive technology.

FIG. 4 shows a fan unit (a type of air handling apparatus 23) with an acoustic treatment 8 installed to reduce noise emitted by the fan. Such a lining would often be installed with smaller (e.g., smaller than the largest) diameter fans (e.g., such lining could be for the 27 or 22-inch fan), although it could indeed be used with fans of any size. The thickness of the lining is sized to reduce outlet noise and maintain a constant axial velocity leaving the fan unit. The inner housing 5 may also be acoustically treated (e.g., lined). The base unit may also include springs 9 to minimize vibration.

Figure 5:
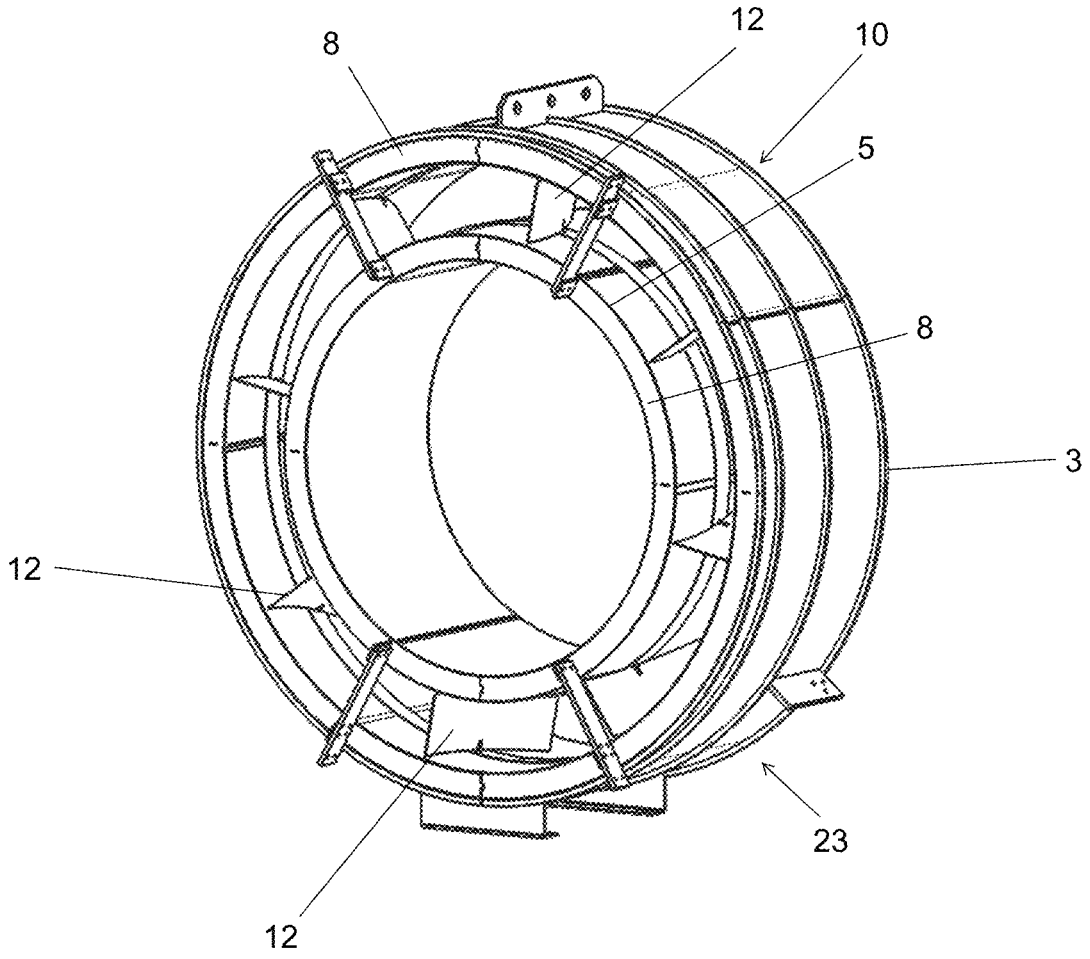
FIG. 5 shows a perspective view of a modular housing extension as may appear in particular embodiments of the inventive technology.
Figure 6:
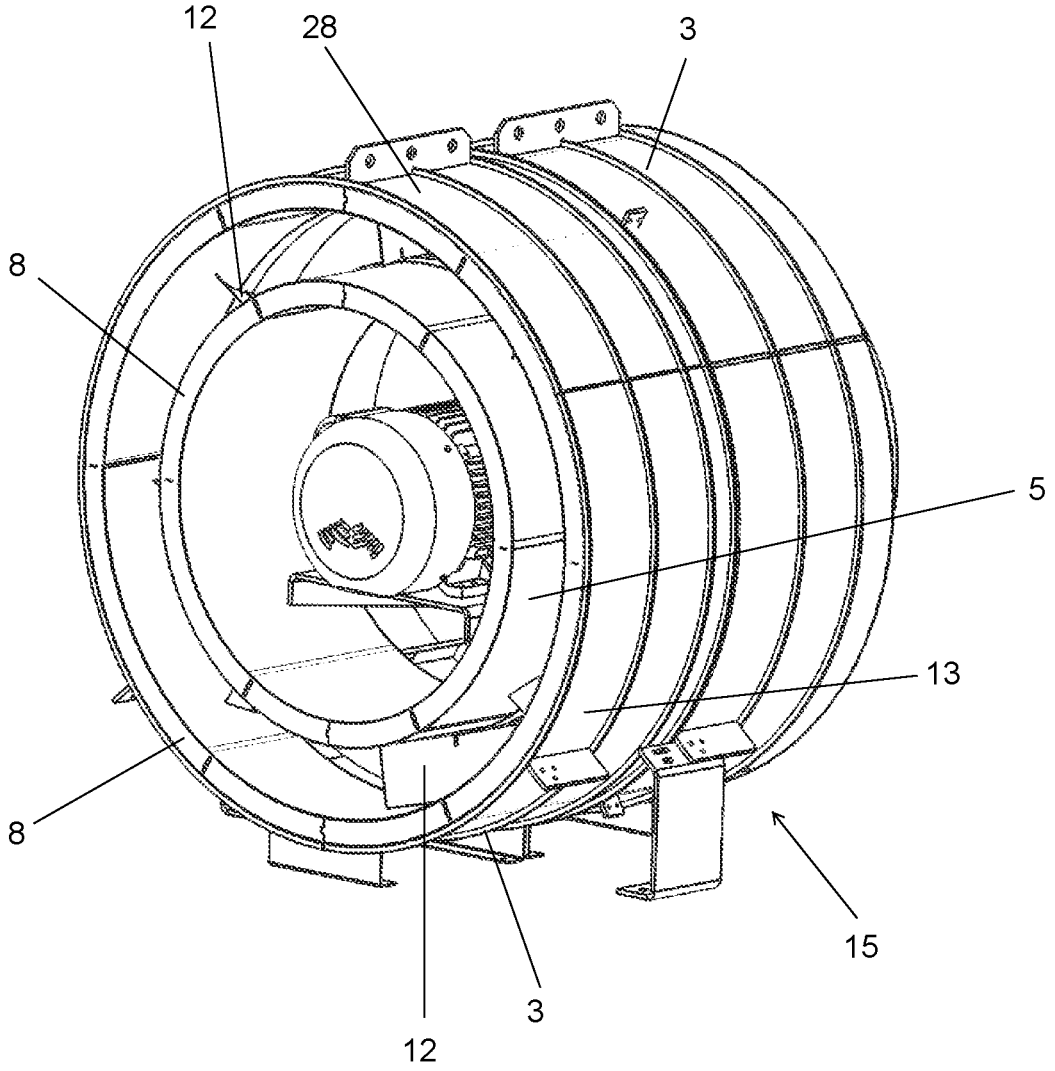
FIG. 6 shows a perspective view from the rear of a fan unit, with a modular extension attached as part thereof, as may appear in particular embodiments of the inventive technology.
Figure 7:
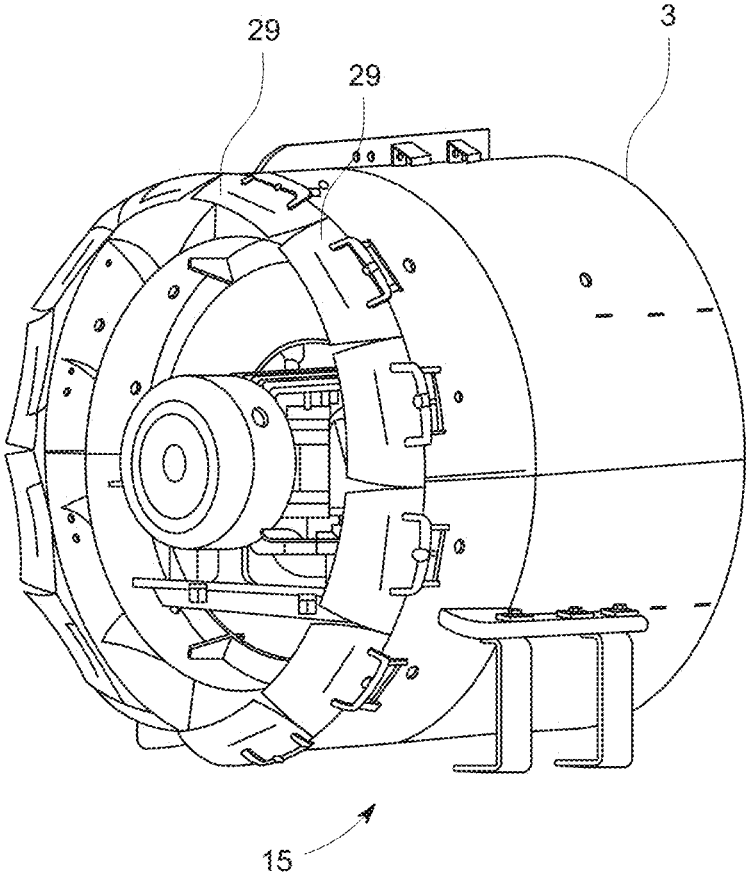
FIG. 7 shows a perspective view from the rear of a fan unit, as may appear in particular embodiments of the inventive technology.
Figure 8:
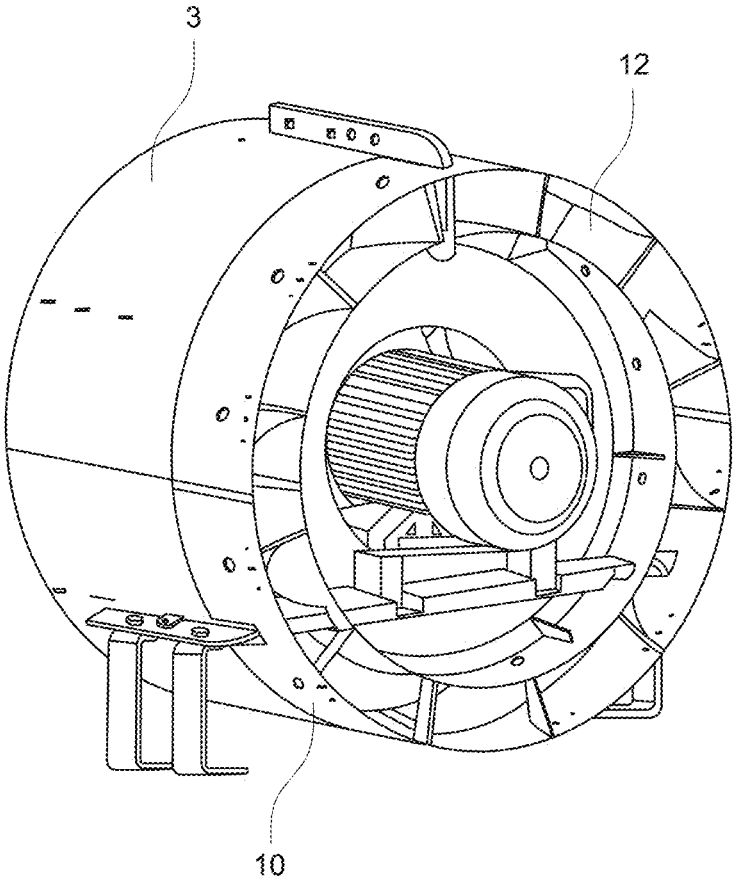
FIG. 8 shows a perspective view from the rear of a fan unit, as may appear in particular embodiments of the inventive technology.
Figure 9:
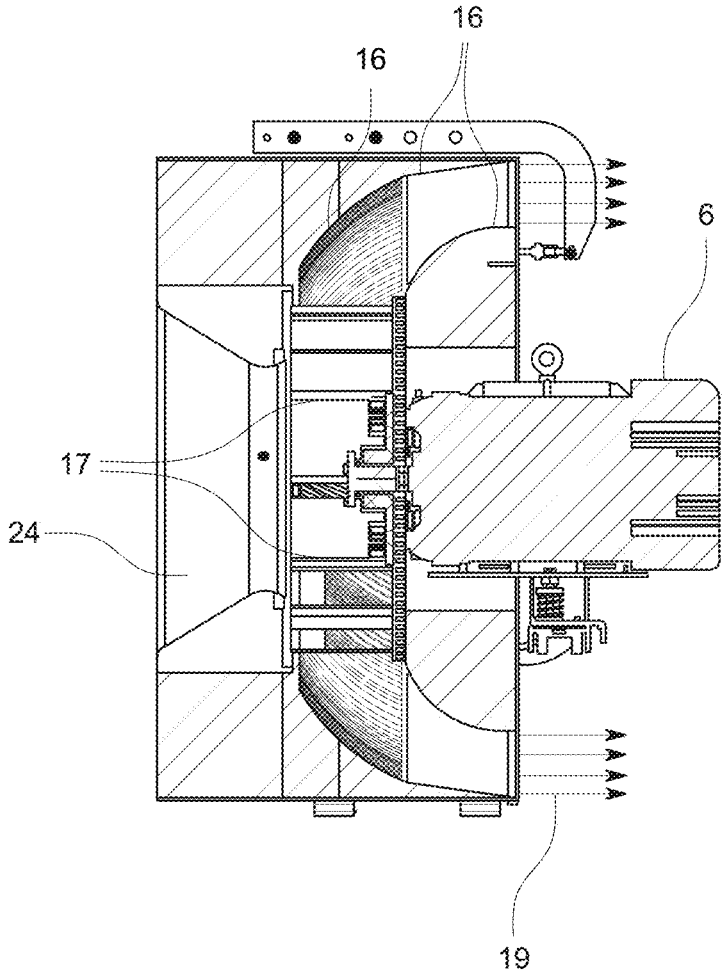
FIG. 9 shows a cross-sectional view from the right side of a fan unit, as may appear in particular embodiments of the inventive technology.

FIG. 5 shows an annular housing extension 10 with a series of fixed (turning) vanes 12 that could be attached to the base unit (e.g., to its annular housing 3) to increase the static efficiency of, e.g., the largest diameter fan (in the example, the 30-inch fan.) An unlined extension could be attached to a housing, whether that housing is unlined or not. An acoustically treated extension 13 could often be attached to a lined housing to reduce acoustic output. The vanes 12 could be manually or automatically adjusted to optimally match fan performance to produce the maximum possible efficiency. FIG. 6 shows an insulated extension 28 attached to modular unit. The acoustic treatment (e.g., lining) in the extension 13 is often matched in diameter to the acoustic treatment (e.g., lining) in a fan unit.

From this disclosure, it will be obvious to one skilled in the art that the appurtenances and design features disclosed herein could be applied to any dimension or type of fan (though most usefully a centrifugal fan 18) by adjusting the diameter of the housing 3, any vanes 12 and any insulation, regardless of where it may be, appropriately. Specific applications of this technology might require different combinations of insulation, vanes, or inlets (e.g., inlet cones 24); such may be done without altering the basic nature of the claimed inventive technology. It will also be apparent that the specific dimension, number of vanes, and other detailed design features can be changed without altering the novelty of the claimed concept.

Particular embodiments of the inventive technology may present an outwardly divergent diffuser 22 established to act on the output from a centrifugal fan 18. Such may be allowed for via the housing shaped to yield an annular output 19, or generally an output that is parallel with the fan axis of rotation 21; the tapered diffuser may be attached to, or even form part of, that housing (a term that includes a housing extension 10). Indeed, it may be the annular discharge (created by a housing shaped to output such discharge, that may make at least some of the diffuser embodiments possible. Where the most downflow terminus of one or both of the surfaces that shape the centrifugal fan's flow output (e.g., the inner and/or outer surface) are outwardly tapered or outwardly flared (or otherwise diverge away from the center annulus of the flow), an outwardly divergent diffuser is said to exist. In certain embodiments, particularly those where the diffuser involves inner and outer divergent surfaces, the diffuser's cross-sectional shape (in a plane that includes the fan's axis of rotation 21), may be conical, whether such shape presents with straight or curved surfaces. Either or both surfaces may diverge from the other in the substantial area of the downward terminus of the surfaces that shape the fan's output. Such divergent shape increases the cross-sectional area of the flow at that section, thereby decreasing average speed of such flow, and achieving a desired increase in static pressure.

In particular embodiments, the surface of the diffuser 22, whether inner, outer or both, may exhibit a divergence angle 44 (which in the case of curved or other surfaces that are not entirely straight, is the average angle) of from 3°-15°, 5°-10°, 6°-8°, and substantially 7° (the angle of the diverted surfaces with respect to a nominal undiverted annular surface 43, which is an imaginary cylindrical surface that would appear but for diversion of such surface; in cross-section, such undiverted surface may appear as two lines above and below, equidistant from, and parallel with, a fan axis of rotation). Note that intermediate circumferential surfaces (splitters) that also act to diverge the flow (i.e., via increase of flow cross-sectional area), are considered part of the diffuser. Such splitters may allow for an increase of the divergence angle; hence the pressure recovery could be increased relative to the use of a diffuser without such splitter(s).

The diffuser 22 may be considered an appurtenance similarly to the housing extension 10, the fixed vanes, the acoustic treatment 8, etc. The diffuser may itself include such fixed vanes and/or acoustic treatment. In certain embodiments, it can be configured so that it can be added onto, and as part of, a centrifugal fan unit (e.g., via retrofit onto an existing unit). Note that diffusers have been used in other applications, but their application to a centrifugal fan 18 is inventive. Any known diffuser technology, isolated from its application in known manner, could be used in novel fashion to increase static pressure produced by a centrifugal fan.

Regardless of the precise goal of an application (i.e., regardless of which one or more performance parameters an application is intended to improve), certain embodiments of the inventive technology may be described as: selecting a particular size annular housing for a centrifugal fan unit 15 in a certain plenum application; identifying a performance parameter that is compromised to a compromised parameter value (e.g., a lower efficiency, a higher energy consumption, etc.) when the centrifugal fan unit with the particular size annular housing is outfit with a fan wheel having a traditionally used size for the particular size annular housing and is used in the certain plenum application; establishing, in the particular size annular housing for the certain plenum application, a fan with a fan wheel 17 having a size that is within the smallest one-third or the largest one-third of the fan wheel sizes of fans that can fit within the particular size annular housing; and improving the performance parameter relative to the compromised parameter value when the centrifugal fan unit with the particular size annular housing is outfit with the smaller or larger fan wheel size and used in the certain plenum application. Such identification can occur upon recognition that a performance parameter can be improved upon, e.g., use of a non-traditionally sized fan wheel in the housing of particular size, and perhaps one or more appurtenances.

Examples of such performance parameters include but are not limited to: fan efficiency, fan noise, and any combination of the preceding, all without limiting other aspects. Note that embodiments may be implemented in a system in those situations where use of a fan of a traditionally used (fan wheel) size in that certain application would result in compromised performance with respect to at least one performance index selected from the group consisting of: compromised sound performance, and compromised efficiency.

Note that in particular embodiments, the adaptive fans and the appurtenances described herein can be arranged in arrays within an airhandler to meet ventilation requirements without altering the inventiveness of the described features.

In any of the various embodiments of the inventive technology, a damper 29 could be installed downstream of the fan as part of the fan unit, on a housing extension 10. The damper 29, basically an array of hinged plates that flap down to prevent reverse flow if the unit is off, and are forced up (held open) by flow leaving the unit during operation, is, like many features, optional, but perhaps important in certain embodiments where reverse flow is problematic.

As can be easily understood from the foregoing, the basic concepts of the present invention may be embodied in a variety of ways. It involves both air handling techniques as well as devices to accomplish such air handling. In this application, the air handling techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "diffuser" should be understood to encompass disclosure of the act of "diffusing"—whether explicitly discussed or not—and, conversely, were there effectively disclosure of the act of "diffusing", such a disclosure should be understood to encompass disclosure of a "diffuser" and even a "means for diffusing" Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the air handling devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. Of course, the disclosure provided herein should be understood to include a system substantially as herein described with reference to any one or more of the Figures and Description, in addition to a system/apparatus where any of the features disclosed herein are combined in any possible combination or permutation.

What is claimed is:

1. An air handling method, comprising the steps of:

selecting a first fan housing of a certain housing size, said first fan housing of said certain housing size having an annular interior and capable of housing a centrifugal fan having one of a plurality of different fan wheel outer diameters;

selecting one of said plurality of different fan wheel outer diameters from a largest one-third or a smallest one-third of said plurality of different fan wheel outer diameters that can be housed in said first fan housing of said certain housing size;

installing a first centrifugal fan having a first fan wheel of said selected one of said different fan wheel outer diameters inside of said first fan housing of said certain housing size to generate a first, single inlet fan unit, wherein said first, single inlet fan unit is a supply fan unit, wherein said first fan wheel rotates about a first fan axis of rotation, and wherein said first, single inlet fan unit expels a first fan annular output in a direction parallel with said first fan axis of rotation;

providing a first inlet cone as part of said first, single inlet fan unit;

providing a first sliding sleeve that is fixed with respect to said first inlet cone, within or around a first fixed collar that is attached to said first fan housing, said first inlet cone configured to conically redirect first fan inlet air into said first, single inlet fan unit upon installation;

adjusting a penetration depth of said first inlet cone into said first fan housing by sliding said first sliding sleeve with respect to said first fixed collar, along said first fan axis of rotation, until a fan proximal part of said first inlet cone is at a first position relative to said first fan wheel, leaving said first inlet cone at a first penetration depth relative to said first fixed collar; and securing said first sliding sleeve relative to said first fixed collar so that said fan proximal part of said first inlet cone is secured at said first position, and said first sliding sleeve and said first inlet cone are immobile, along said first fan axis of rotation, relative to said first fixed collar, during operation of said first centrifugal fan;

installing, as part of said first, single inlet fan unit, at least one appurtenance selected from the group consisting of: an annular housing extension, a plurality of fixed vanes established in a flowpath of said first fan annular output, an outwardly divergent diffuser, and acoustic treatment;

installing a second, single inlet fan unit in fluidic communication with said first, single input fan unit, wherein said second, single inlet fan unit is a return fan unit that comprises:

a second centrifugal fan having a second fan wheel of an outer diameter that is different from said selected one of said different fan wheel outer diameters of said first fan wheel, wherein said second fan wheel rotates about a second fan axis of rotation, and wherein said return fan unit expels a second fan annular output in a direction parallel with said second fan axis of rotation;

a second fan housing that is separate and distinct from said first fan housing but that is of said certain housing size of said first fan housing;

a second inlet cone established as part of said return fan unit and configured to conically redirect fan inlet air into said return fan unit; and an adjustable collar system that allows sliding adjustment of penetration depth of said second inlet cone into said second fan housing, said adjustable collar system comprising:

a second sliding sleeve that is fixed with respect to said second inlet cone, a second fixed collar that is attached to said second fan housing, and a securement element that secures said second sliding sleeve relative to said second fixed collar so that a fan proximal part of said second inlet cone is secured at a second position relative to said second fan wheel, thereby securing said second inlet cone at a second penetration depth relative to said second fixed collar, and so that said second sliding sleeve and said second inlet cone are immobile, along said second fan axis of rotation, relative to said second fixed collar, during operation of said second centrifugal fan;

wherein said return fan unit further comprises at least one appurtenance selected from the group consisting of: an annular housing extension, a plurality of fixed vanes established in a flowpath of said second fan annular output, an outwardly divergent diffuser, and acoustic treatment.

2. An air handling method as described in claim 1 wherein said step of selecting one of said plurality of different fan wheel outer diameters comprises the step of selecting a fan from three different commercially available outer diameters of fans that can fit in said first fan housing.

3. An air handling method as described in claim 1 and further comprising the step of identifying at least one air handling performance goal for an air handling application, said at least one air handling performance goal is selected from the group consisting of: efficiency goal, sound goal, static pressure goal, an engine speed goal, an engine horsepower goal, engine size goal, an energy consumption goal, an operating cost goal.

4. An air handling method as described in claim 1 and further comprising acoustic treatment established as part of said first, single inlet fan unit.

5. An air handling method as described in claim 1 and further comprising fixed vanes established within a flow path of said first fan annular output.

6. An air handling method as described in claim 1 and further comprising an outwardly divergent diffuser established as part of said first, single inlet fan unit to enlarge a cross-sectional flow area of said first fan annular output.

7. An air handling method as described in claim 1 wherein said first fan housing comprises a housing extension.

8. An air handling method as described in claim 1 wherein said first inlet cone is part of an inlet cone unit that comprises an annular plate.

9. An air handling method as described in claim 1 wherein said second penetration depth relative to said second fixed collar is different from said first penetration depth relative to said first fixed collar.

10. An air handling method as described in claim 9 wherein said first position and said second position are selected so as not to result in loss of flow or efficiency through said first, single inlet fan unit and said second, single inlet fan unit, respectively.

11. An air handling apparatus, comprising:

a first, single inlet fan unit comprising:

a first centrifugal fan defining a first fan axis of rotation;

a first fan housing at least partially around said first centrifugal fan, said first fan housing of a first housing size, having an annular interior, and configured to expel a first fan annular output in a direction parallel with said first fan axis of rotation, wherein said first fan housing is capable of housing a centrifugal fan having one of a plurality of different fan wheel outer diameters, and wherein said first centrifugal fan comprises a first fan wheel of a first fan wheel outer diameter that is from either a largest one-third or a smallest one-third of said plurality of different fan wheel outer diameters that can be housed in said first fan housing;

a first inlet cone configured to conically redirect first fan inlet air into said first centrifugal fan;

a first adjustable collar system that allows sliding adjustment of penetration depth of said first inlet cone into said first fan housing, said first adjustable collar system comprising:

a first sliding sleeve that is fixed with respect to said first inlet cone, a first fixed collar that is attached to said first fan housing, and a first securement element that secures said first sliding sleeve relative to said first fixed collar so that a fan proximal part of said first inlet cone is secured at a first position relative to said first fan wheel, thereby securing said first inlet cone at a first penetration depth relative to said first fixed collar, and so that said first sliding sleeve and said first inlet cone are immobile, along said first fan axis of rotation, relative to said first fixed collar, during operation of said first centrifugal fan; and at least one appurtenance installed as part of said first, single inlet fan unit and selected from the group consisting of: a housing extension; a plurality of fixed vanes established within a flowpath of said first fan annular output; and an outwardly divergent diffuser;

said air handling apparatus further comprising a second, single inlet fan unit in fluidic communication with said first, single inlet fan unit, said second, single inlet fan unit comprising:

a second centrifugal fan defining a second fan axis of rotation and comprising a second fan wheel of a second fan wheel outer diameter that is different from said first fan wheel outer diameter;

a second fan housing that is of said first housing size of said first fan housing, and that is configured to expel a second fan annular output in a direction parallel with said second fan axis of rotation;

a second inlet cone configured to conically redirect second fan inlet air into said second centrifugal fan; and a second adjustable collar system that allows sliding adjustment of penetration depth of said second inlet cone into said second fan housing, said second adjustable collar system comprising:

a second sliding sleeve that is fixed with respect to said second inlet cone, a second fixed collar that is attached to said second fan housing, and a second securement element that secures said second sliding sleeve relative to said second fixed collar so that a fan proximal part of said second inlet cone is secured at a second position relative to said second fan wheel, thereby securing said second inlet cone at a second penetration depth relative to said second fixed collar, and so that said second sliding sleeve and said second inlet cone are immobile, along said second fan axis of rotation, relative to said second fixed collar, during operation of said second centrifugal fan;

wherein said second, single inlet fan unit further comprises at least one appurtenance installed as part of said second, single inlet fan unit and selected from the group consisting of: a housing extension; a plurality of fixed vanes established within a flowpath of said second fan annular output; and an outwardly divergent diffuser, wherein said second, single inlet fan unit expels a second annular output in a direction parallel with said second fan axis of rotation, and wherein said first, single inlet fan unit is a supply fan unit and said second, single inlet fan unit is a return fan unit.

12. An air handling apparatus as described as in claim 11 wherein said first housing size is a diameter of 50 inches and said plurality of different fan wheel outer diameters include 18 inches, 24 inches, and 27 inches.

13. An air handling apparatus as described as in claim 11 wherein said first housing size is a diameter of 52 inches and said plurality of different fan wheel outer diameters include 22 inches, 27 inches, and 30 inches.

14. An air handling apparatus as described as in claim 11 wherein said first housing size is a diameter of 54 inches and said plurality of different fan wheel outer diameters include 24½ inches, 27 inches, and 30 inches.

15. An air handling apparatus as described as in claim 11 wherein said first housing size is a diameter of 60 inches and said plurality of different fan wheel outer diameters include 24 inches, 27 inches, and 31 inches.

16. An air handling apparatus as described as in claim 11 wherein said first housing size is a diameter of 62 inches and said plurality of different fan wheel outer diameters include 29 inches, 27 inches, 25 inches, and 23 inches.

17. An air handling apparatus as described as in claim 11 and further comprising acoustic treatment established as part of said supply fan unit.

18. An air handling apparatus as described as in claim 17 wherein said acoustic treatment is established within said first fan housing of said first, single inlet fan unit.

19. An air handling apparatus as described in claim 11 wherein said first inlet cone is part of an inlet cone unit that comprises an annular plate.

20. An air handling method, comprising the steps of:

selecting a first fan housing of a certain housing size, said fan housing of said certain housing size having an annular interior and capable of housing a centrifugal fan having one of a plurality of different fan wheel outer diameters;

selecting one of said different fan wheel outer diameters from a largest one-third or a smallest one-third of said plurality of different fan wheel outer diameters that can be housed in said first fan housing of said certain housing size;

installing a first centrifugal fan having a first fan wheel of said selected one of said different fan wheel outer diameters inside of said first fan housing of said certain housing size to generate a first, single inlet fan unit, wherein said first, single inlet fan unit is a supply fan unit, said first fan wheel rotates about a first fan axis of rotation, and wherein said first, single inlet fan unit expels a first fan annular output in a direction parallel with said first fan axis of rotation;

providing a first inlet cone as part of said first, single inlet fan unit;

providing a first sliding sleeve that is fixed with respect to said first inlet cone within or around a first fixed collar that is attached to said first fan housing, said first inlet cone configured to conically redirect first fan inlet air into said first centrifugal fan upon installation;

adjusting a penetration depth of said first inlet cone into said first fan housing by sliding said first sliding sleeve with respect to said first fixed collar, along said first fan axis of rotation, until a fan proximal part of said first inlet cone is at a first position relative to said first fan wheel, leaving said first inlet cone at a first penetration depth relative to said first fixed collar;

securing said first sliding sleeve relative to said first fixed collar so that said fan proximal part of said first inlet cone is secured at said first position and said first sliding sleeve and said first inlet cone are immobile, along said first fan axis of rotation, relative to said first fixed collar, during operation of said first, single inlet fan unit;

installing, as part of said first, single inlet fan unit, at least one appurtenance selected from the group consisting of: an annular housing extension, a plurality of fixed vanes established in a flowpath of said first fan annular output, an outwardly divergent diffuser, and acoustic treatment;

selecting, for a second fan wheel, a second fan wheel outer diameter that is different from said selected one of said different fan wheel outer diameters of said first fan wheel;

installing a second centrifugal fan having said second fan wheel of said second fan wheel outer diameter inside of a second fan housing that is separate and distinct from said first fan housing, said second fan housing being of said certain housing size of said first fan housing, to generate a second, single inlet fan unit as a return fan unit that is in fluidic communication with said supply fan unit, wherein said second fan wheel rotates about a second fan axis of rotation, and wherein said second, single inlet fan unit expels a second fan annular output in a direction parallel with said second fan axis of rotation;

providing a second inlet cone as part of said second, single inlet fan unit and configured to conically redirect second fan inlet air into said return fan unit upon installation;

providing a second sliding sleeve that is fixed with respect to said second inlet cone within or around a second fixed collar that is attached to said second fan housing;

adjusting a penetration depth of said second inlet cone into said second fan housing by sliding said second sliding sleeve with respect to said second fixed collar, along said second fan axis of rotation, until a fan proximal part of said second inlet cone is at a second position relative to said second fan wheel, leaving said second inlet cone at a second penetration depth relative to said second fixed collar, and wherein said second penetration depth relative to said second fixed collar is different from said first penetration depth relative to said first fixed collar;

securing said second sliding sleeve relative to said second fixed collar so that said fan proximal part of said second inlet cone is secured at said second position and said second sliding sleeve and said second inlet cone are immobile, along said second fan axis of rotation, relative to said second fixed collar during operation of said second centrifugal fan; and installing, as part of said second, single inlet fan unit, at least one appurtenance selected from the group consisting of: an annular housing extension, a plurality of fixed vanes established in a flowpath of said second fan annular output, an outwardly divergent diffuser, and acoustic treatment.

21. An air handling method as described in claim 20 further comprising the step of identifying at least one air handling performance goal for an air handling application, said at least one air handling performance goal is selected from the group consisting of: efficiency goal, sound goal, static pressure goal, an engine speed goal, an engine horsepower goal, engine size goal, an energy consumption goal, an operating cost goal.

22. An air handling method as described in claim 20 wherein said first position and said second position are selected so as not to result in loss of flow or efficiency through said first, single inlet fan unit and said second, single inlet fan unit, respectively.

* * * * *